United States Patent [19]

Goto et al.

[11] Patent Number: 4,892,368

[45] Date of Patent: Jan. 9, 1990

[54] DRAWER SLIDE

[75] Inventors: Takashi Goto, Euless, Tex.; George E. Malcom, Elkhart, Ind.

[73] Assignee: Malgo Corporation, Grand Prairie, Tex.

[21] Appl. No.: 252,119

[22] Filed: Oct. 3, 1988

[51] Int. Cl.[4] ..... A47B 88/00

[52] U.S. Cl. ..... 312/348; 312/341.1; 384/21

[58] Field of Search ..... 312/348, 336, 341 NR, 312/343, 344; 384/21

[56] References Cited

U.S. PATENT DOCUMENTS

| | | | |
|---|---|---|---|
| 1,851,855 | 3/1932 | Lindemann et al. | 312/343 X |
| 2,318,800 | 5/1943 | Rakow | 312/343 X |
| 3,185,530 | 5/1965 | Reiss Sr. et al. . | |
| 3,658,394 | 4/1972 | Gutner . | |
| 3,909,078 | 9/1975 | Riley . | |
| 3,923,347 | 12/1975 | Dean . | |
| 4,018,488 | 4/1977 | Manson | 312/343 X |
| 4,033,639 | 7/1937 | Benoit et al. | 384/21 |
| 4,061,375 | 12/1977 | Mertes . | |
| 4,125,297 | 11/1978 | Mertes . | |
| 4,600,255 | 7/1986 | Dubasko | 312/348 X |
| 4,765,699 | 8/1988 | Bessinger et al. | 312/348 X |

*Primary Examiner*—Joseph Falk

*Attorney, Agent, or Firm*—Charles D. Gunter Jr.

[57] ABSTRACT

A drawer slide assembly is shown including a slide body which is secured to the bottom surface of a drawer. The slide body has a pair of spaced guides which engage a mating track. Each of the guides has a vertical wall portion and a perpendicular lip. The vertical wall portion and lip together define a L-shaped cross-section. A strut interconnects the spaced guides in transverse fashion. The strut has a vertically extending front wall which extends for a preselected depth, less than the depth of said guides, to engage a stop provided in the mating track. The depth of the vertically extending front wall is selected to allow the strut to ride over the stop when the guides are canted at an angle in the mating track to thereby release the drawer slide.

4 Claims, 3 Drawing Sheets

DRAWER SLIDE

BACKGROUND OF THE INVENTION

1. Field of the Invention

The present invention relates to pull-out drawer assemblies and to an improved drawer slide for use in such assemblies.

2. Description of the Prior Art

A variety of complicated guide and slide means have been proposed for pull-out type drawers. Nevertheless, the prior art devices have suffered from certain deficiencies. Conventionally, the slide member is mounted on the underside of a drawer for slidably engaging a track mounted within the furniture opening so that the drawer can be pulled or drawn easily from its storage cavity. Certain of the prior art drawer assemblies have failed to adequately support the drawer as it moves on its track to prevent tilting or displacement during movement. Other prior art devices included a number of components which were required to be separately and carefully installed in order to obtain proper alignment. Other of the prior art drawer slides extended the full length of the drawer and had specially molded components at each end thereof. As a result, such slides where required to be specially made to fit each of the many different available drawer lengths.

In the case of drawer slides used in the cabinets of mobile homes and recreational vehicles, a positive stop to prevent inadvertent release of the drawer from the cabinet opening was desirable. For instance, U.S. Pat. No. 4,125,297, issued Nov. 14, 1978, to Mertes, shows a drawer slide with a selectively releasable, depending hook for engaging a stop provided in the cabinet track. To release the hook, it was necessary to manipulate the resilient hook out of the engagement position by flexing the hook with the user's fingers.

A need exists, therefore, for an inexpensive and rugged drawer slide assembly which can be produced for low cost and yet which is very durable.

A need also exists for a drawer slide which is formed in one piece and which can be simply and inexpensively installed on drawers of various widths and lengths.

A need also exists for such a slide assembly which prevents misalignment of the drawer during movement.

A need also exists for such a drawer slide which includes a positive stop to prevent inadvertent release of the drawer from the cabinet opening and yet which can be released without danger of pinching or otherwise injuring the user's fingers.

SUMMARY OF THE INVENTION

The drawer slide of the invention is adapted to be secured to the bottom surface of a drawer to engage a mating track. The slide includes a body member which has a pair of spaced guides depending downward therefrom a predetermined depth for engaging a mating track. Each of the guides has a vertical wall portion and a perpendicular lip. The vertical wall portion and lip together define a L-shaped cross-section. A strut interconnects the spaced guides in transverse fashion. The strut has a rigid, vertically extending front wall which extends for a preselected depth, less than the depth of said guides, to engage a stop provided in the mating track. The strut also has a beveled rear face for sliding over the stop as the drawer is being mounted. The depth of the vertically extending front wall is selected to allow the strut to ride over the stop when the guides are canted at an angle in the mating track to thereby release the drawer slide.

Additional objects, features and advantages will be apparent in the written description which follows.

DETAILED DESCRIPTION OF THE INVENTION

Figure 1:
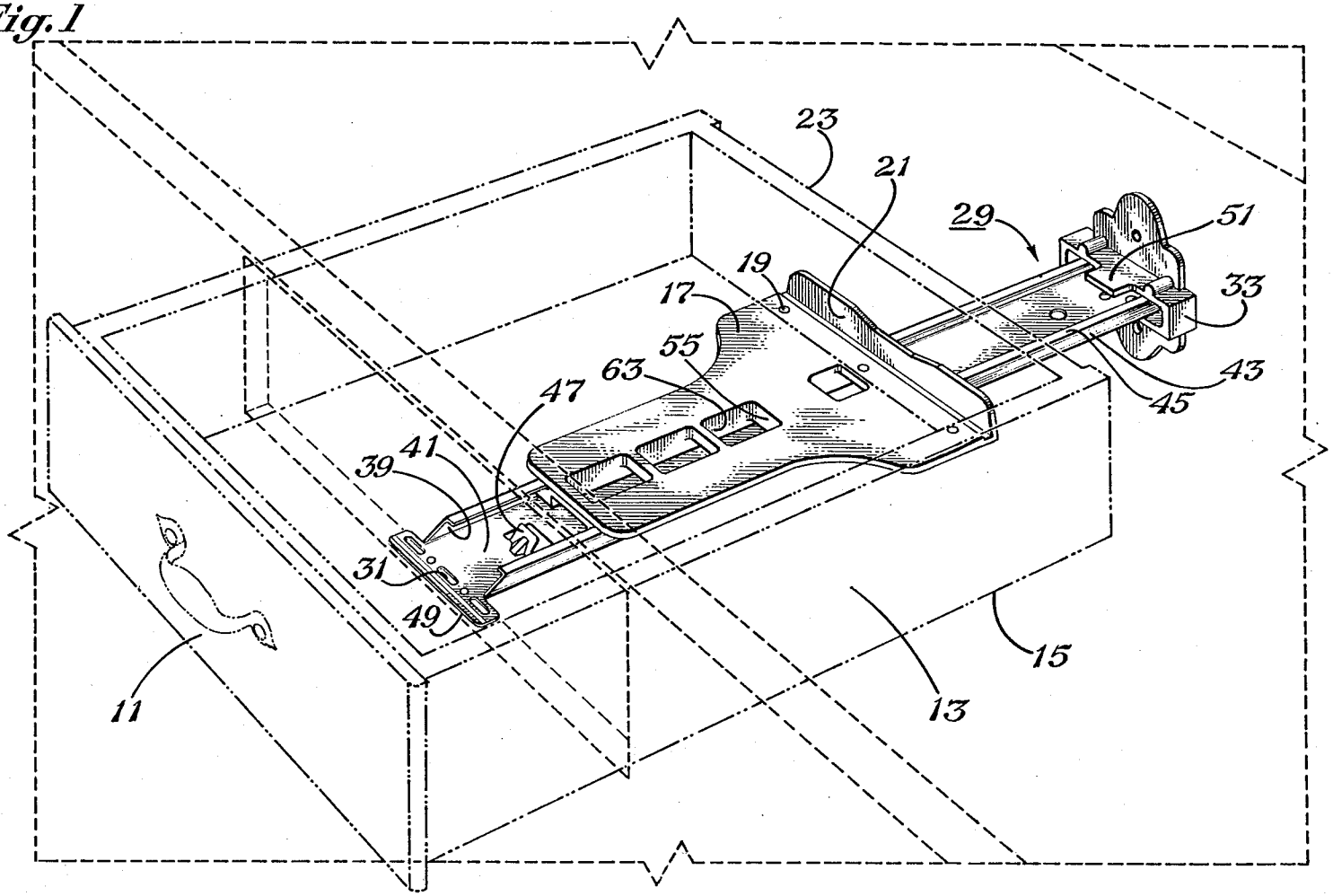
FIG. 1 is a perspective view of the drawer slide assembly of the invention showing the assembly in place on the bottom of a drawer within a cabinet, the drawer and cabinet being shown in dotted lines.

FIG. 1 shows a pull-out drawer assembly including a drawer 11 having sidewalls 13 and a bottom surface 15. The drawer is received within an opening provided in a cabinet shown in dotted lines. A body member 17 is secured to the bottom surface 15 of the drawer 11 as by screws provided in screw holes 19. The screw holes are located along the rear edge of bottom surface 15. An upwardly extending rear flange 21 fits flush with the back sidewall 23 of the drawer 11. The body member is preferably formed of molded plastic.

Figure 5:
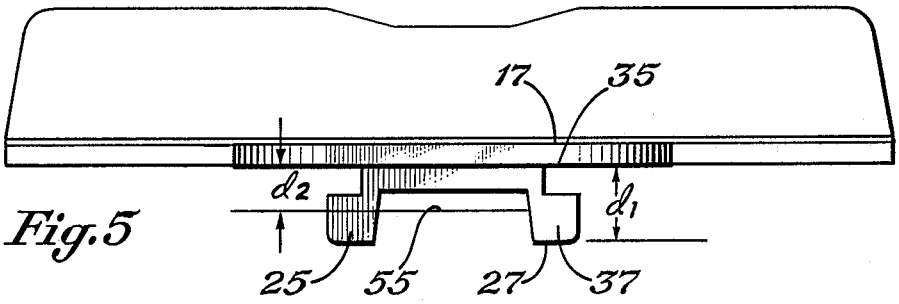
FIG. 5 is a front view of the body member of the drawer slide in place on the bottom of a drawer, showing the downwardly depending spaced guides.
Figure 7:
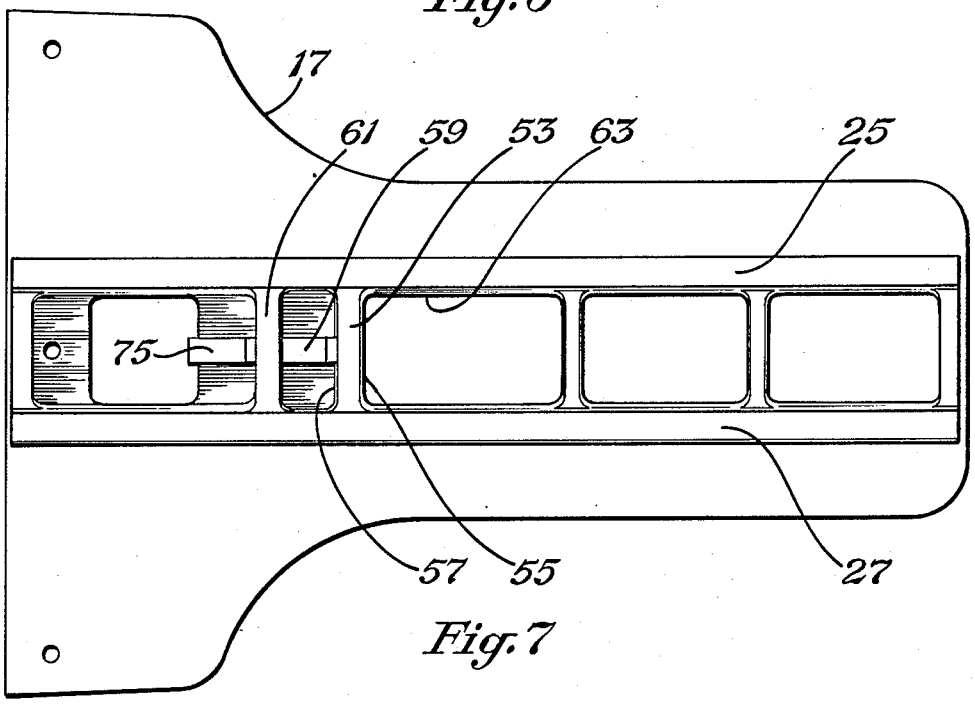
FIG. 7 is a bottom view of the body member of the slide of the invention.

As shown in FIGS. 5 and 7, a pair of spaced guides 25, 27 depend downwardly from the body member 17 a predetermined depth ($d_1$ in FIG. 5) for engaging a mating track (29 in FIG. 1). The mating track is fixedly mounted within the cabinet by means of screws provided in front screw holes 31 and by means of a rear mounting bracket 33.

Turning again to FIG. 5, each of the guides 25, 27 has a vertical wall portion 35 and a perpendicular lip 37. The vertical wall portion 35 and perpendicular lip 37 together define a L-shaped cross-section. As shown in FIG. 7, the guides 25, 27 run for substantially the length of the body member 17. As shown in FIG. 1, the body member 17 is generally less than the length of the drawer bottom surface 15. Preferably, the body member 17 is less than half the length of the bottom surface 15.

The mating track (29 in FIG. 1) extends for substantially the length of the drawer 11 when the drawer is in the closed position. The track 29 has opposed channel regions 39, 41 which provide a sliding fit above and below the guides 25, 27 for substantially the entire length of the guides. The channel regions are formed by a vertical wall portion 43 and overhanging lip 45. The mating track 29 is provided with a forward stop member 47 extending upwardly between the channel regions 39, 41 near the outer extent 49 of the track 29. A flange 51 on the rear mounting bracket 33 provides a rearward stop for the body member 17. The forward stop member 47 and mating track are preferably formed of metal. The forward stop member 47 forms an acute angle with the track 29 and leans in the direction of the rear mounting bracket 33. As a result, the forward stop member 47 is deflectable slightly in the direction of the track 29 and rear mounting bracket 33.

Figure 4:
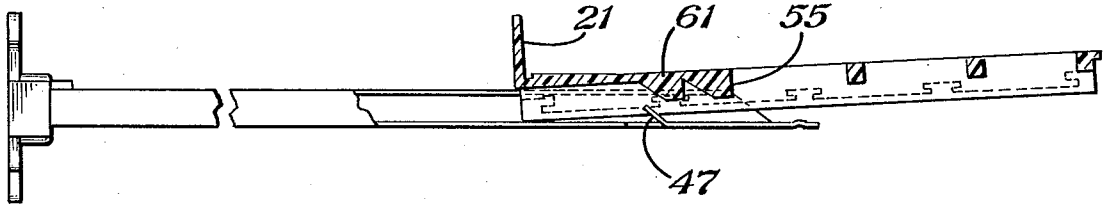
FIG. 4 is a cross-sectional view similar to FIG. 3 of the slide being released by canting the slide guides vertically upward within the mating track.

As shown in FIG. 7, the body member 17 has a primary strut 53 which interconnects the spaced guides 25, 27 in transverse fashion, spanning the longitudinal opening (63 in FIG. 1) formed by the guides 25, 27. With respect to the length ($l_1$ in FIG. 6) of the body member 17, the primary strut 53 is located rearward of the midpoint of the body member 17. The primary strut 53 has a vertically extending front wall 55 which extends for a preselected depth ($d_2$ in FIG. 5) which is less than the depth $d_1$ of said guides 25, 27. The depth $d_2$ is preselected to engage the forward stop 47 provided in the mating track 29 to prevent the inadvertent release of the drawer 11 from the track 29. The strut 53 is generally rectangular in cross-section, having vertically extending front and rear walls separated by a uniform thickness. The rear wall 57 has a triangular wedge formed thereon and extending perpendicular thereto which provides a beveled rear face 59 for deflecting and sliding over the forward stop 47 as the drawer is being mounted. The depth d2 of the vertically extending front wall 55 of primary strut 53 is selected to allow the strut 53 to ride over the forward stop 47 (FIG. 4) when the guides 25, 27 are canted at an angle in the mating track 29 to thereby release the drawer slide.

Preferably, a backup strut 61 is located immediately behind the primary strut. The backup strut 61 is identical to the primary strut 53 and spans the longitudinal opening 63 formed by the guides 25, 27, interconnecting the spaced guides in transverse fashion.

Figure 6:
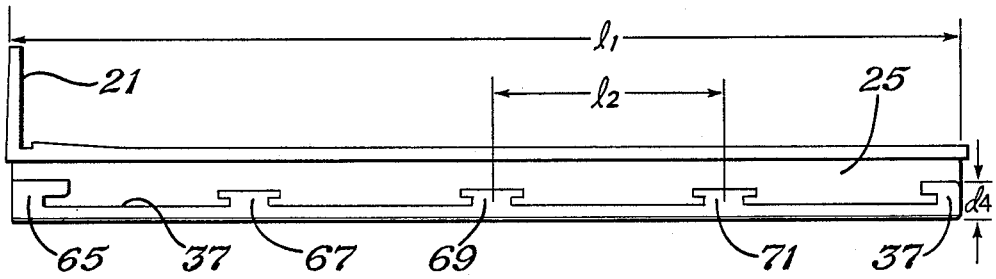
FIG. 6 is a side view of the body member of the drawer slide of the invention.

As shown in FIG. 6, a plurality of spaced nubs 65, 67, 69, 71, 73 extend upwardly along the perpendicular lip 37 on the exterior of the spaced guides 25, 27 to limit the vertical travel of the guides 25, 27 in the mating track 29. The nubs 67, 69, and 71 are generally T-shaped in appearance while nubs 65 and 73 are a vertically bisected T-shape. The nubs help prevent excess play and wobble as the slide moves in the track 29. The nubs also limit the vertical travel of the guides 25, 27 within the channel openings 39, 41, whereby it is necessary to cant the guides at an angle see FIG. 4) in the mating track 29 to release the drawer slide. The necessary cant angle (alpha in FIG. 4) can only be achieved once a predetermined number of the spaced nubs 65, 67, 69, 71, 73 have cleared the channel regions 39, 41 of the mating track 29 in withdrawing the drawer slide from the track 29.

The operation of the drawer slide will now be described. The track 29 is first installed within the cabinet opening by affixing the outer extent 49 and rear mounting bracket 33 with screws. The body member 17 of the drawer slide is mounted on the bottom surface 15 of the drawer with the rear flange 21 flush against the back sidewall 23. The drawer is then mounted on the track 29 by sliding the guides 25, 27 within the mating channel regions 39, 41. The beveled rear faces 59, 75 of the struts 53, 61 ride over the forward stop 47 and deflect the metallic stop downward to allow the drawer to reach the fully closed position. In use, the forward stop 47 strikes the vertically extending front wall 55 of the primary strut 53 to prevent inadvertent release of the drawer from the track (see FIG. 3). The backup strut 61 provides an additional safety factor to prevent inadvertent release of the drawer from the cabinet opening.

Figure 2:
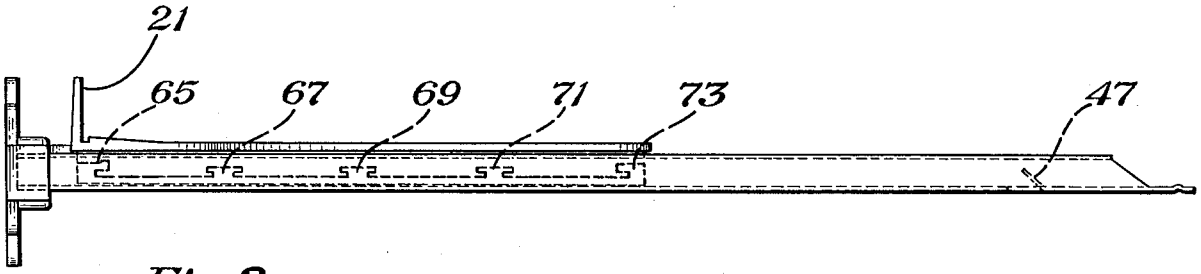
FIG. 2 is a side, isolated view of the drawer slide and track in the fully closed position with portions of the track and slide shown in dotted lines.
Figure 3:
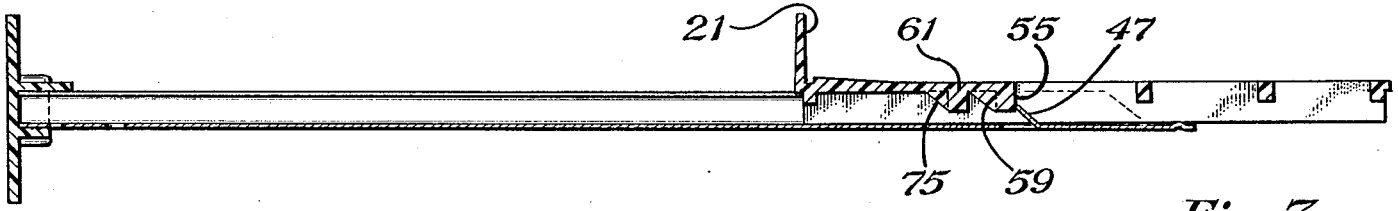
FIG. 3 is a cross-sectional view taken through the center line of the drawer slide and track showing the drawer slide in the fully extended position, contacting the forward stop in the mating track.

To release the drawer from the fully closed position shown in FIG. 2, it is necessary to pull the drawer to the fully open position shown in FIG. 3 with the vertically extending front wall 55 contacting the forward stop 47. At this point, the spaced nubs 69, 71, and 73 have cleared the channel regions 39, 41, thereby allowing the slide to be canted at a preselected cant angle (alpha in FIG. 4). The depth $d_2$ of the front wall portion 55 of the strut 53 is selected to allow the strut to ride over the forward stop 47 when the guides are canted at the angle shown in the mating track 29 to thereby release the drawer slide.

In an actual example, the length of the guides 25, 27 ($l_1$ in FIG. 6) was 6.75 inches. The midpoint of each spaced nub 65, 67, 69, 71, 73 was located at an interval of 1.69 inches. For instance, the distance $l_2$ in FIG. 6 is 1.69 inches. The vertical height ($d_4$ in FIG. 6) of the end nubs 65, 73 was approximately 0.22 inches. The vertical height of the intermediate nubs 67, 69, 71 was approximately 0.12 inches, allowing a clearance of approximately 0.08 to 0.10 inches between the top surface 77 of each spaced nub and the overhanging lip 45 of the track channel region. The distances $d_1$ and $d_2$ in FIG. 5 were 0.413 inches and 0.314 inches, respectively. Because of the spacing of the nubs 65, 67, 69, 71, 73 and the vertical clearance provided between the nubs and channel regions, it is possible to cant the slide at an angle alpha in the range from about 5 to 15 degrees, most preferably 8 to 10 degrees, when the slide is in the position shown in FIG. 4. In this position, three of the spaced nubs 69, 71, 73 have cleared the channel regions 39,41 of the mating track 29.

An invention has been provided with several advantages. The drawer slide of the invention is simple in design and inexpensive to manufacture. The body member 17 can be provided from molded plastic at low cost. The body member is a one-piece unit which is simple to install. Since the slide is less than the length of the drawer, one slide fits a variety of different drawer sizes. The slide action is smooth without excess wobble or play. The positive stop feature prevents inadvertent release of the drawer from the cabinet opening, making the drawer slide of the invention especially suited for use in mobile homes and recreational vehicles. The drawer can be released by grasping the drawer handle and without the necessity of operating a spring detent with the possibility of injuring the user's fingers.

While the invention has been shown in only one of its forms, it is not thus limited but is susceptible to various changes and modifications without departing from the spirit thereof.

I claim:

1. A combination drawer slide and track comprising:

a body member;

a pair of spaced guides depending downward from said body member a predetermined depth for engaging a mating track, each of said guides having a vertical wall portion and a perpendicular lip, the vertical wall portion and lip together defining a L-shaped cross section;

a mating track having opposed channel regions which provide a sliding fit above and below said guides for substantially the entire length of said guides;

a stop member extending upwardly between said channel regions near an outer extent of said track;

a primary strut interconnecting said spaced guides in transverse fashion, said primary strut having a rigid, vertically extending front wall which extends for a preselected depth, less than the depth of said guides, to engage said stop provided in said mating track and having a beveled rear face for sliding over said stop as the drawer is being mounted;

wherein the depth of said rigid, vertically extending front wall is selected to allow said primary strut to ride over said stop when said guides are canted at an angle in said mating track to thereby release said drawer slide;

a plurality of spaced nubs extending upwardly along said perpendicular lip on the exterior of said spaced guides to limit the vertical travel of said guides in said mating tracks, whereby it is necessary to cant said guides at an angle in said mating track to release said drawer slide; and wherein the necessary cant angle can only be achieved once a predetermined number of spaced nubs have cleared the mating tracks in withdrawing said drawer slide from said tracks.

2. A combination drawer slide and track comprising:

a one-piece body member formed of molded plastic;

a pair of parallel guides depending downward from said body member a predetermined depth for engaging a mating track, each of said guides having a vertical wall portion and a perpendicular lip, the vertical wall portion and lip together defining a L-shaped cross-section, said guides being spaced apart to define a longitudinal opening in said body member;

a mating track having opposed channel regions which provide a sliding fit above and below said guides for substantially the entire length of said guides;

a stop member extending upwardly between said channel regions near an outer extent of said track;

a primary strut spanning said longitudinal opening and interconnecting said spaced guides in transverse fashion, said strut having a rigid, vertically extending front wall which extends for a preselected depth, less than the depth of said guides, to engage said stop provided in said mating track and having a beveled rear face for sliding over said stop as the drawer is being mounted;

wherein the depth of said rigid, vertically extending front wall is selected to allow said primary strut to ride over said stop when said guides are canted at an angle in said mating track to thereby release said drawer slide; and wherein a backup strut is located immediately behind said primary strut spanning said longitudinal opening and interconnecting said spaced guides in transverse fashion.

3. The drawer slide of claim 2, wherein each strut is generally rectangular in cross- section, having vertically extending front and rear walls, each of said rear walls having a triangular wedge arranged perpendicular thereto which forms a beveled rear face for sliding over said front stop as the drawer is being mounted.

4. A drawer and slide assembly, comprising a drawer having sidewalls and a bottom surface;

a body member secured to the bottom surface of said drawer;

a pair of spaced guides depending downward from said body member a predetermined depth for engaging a mating track, each of said guides having a vertical wall portion and a perpendicular lip, the vertical wall portion and lip together defining a L-shaped cross-section, said guides running for substantially the length of said body member;

a mating track extending for substantially the length of said drawer when said drawer is in the closed position, said track member having opposed channel regions which provide a sliding fit above and below said guides for substantially the entire length of said guides;

a stop member extending upwardly between said channel regions near an outer extent of said track;

a primary strut interconnecting said spaced guides in transverse fashion, said strut having a rigid, vertically extending front wall which extends for a preselected depth, less than the depth of said guides, to engage said stop provided in said mating track to prevent the inadvertent release of said drawer from said track, said strut having a beveled rear face for sliding over said stop as the drawer is being mounted;

wherein the depth of said rigid, vertically extending front wall is selected to allow said strut to ride over said stop when said guides are canted at an angle in said mating track to thereby release said drawer slide; and wherein a backup strut is located immediately behind said primary strut and interconnecting said spaced guides in transverse fashion.

* * * * *